US005975998A

United States Patent [19]

Olmstead

[11] Patent Number: 5,975,998

[45] Date of Patent: Nov. 2, 1999

[54] WAFER PROCESSING APPARATUS

[75] Inventor: Dennis L. Olmstead, Sherman, Tex.

[73] Assignee: MEMC Electronic Materials , Inc., St. Peters, Mich.

[21] Appl. No.: 08/943,091

[22] Filed: Sep. 26, 1997

[51] Int. Cl.[6] ..... B24B 7/22

[52] U.S. Cl. ..... 451/288; 451/398

[58] Field of Search ..... 451/288, 287, 451/285, 41, 398

[56] References Cited

U.S. PATENT DOCUMENTS

| | | | |
|---|---|---|---|
| 2,411,108 | 5/1948 | Turner | 451/390 |
| 3,631,634 | 1/1972 | Weber | 51/131.4 |
| 3,708,921 | 1/1973 | Cronkhite et al. | 51/131 |
| 3,841,031 | 10/1974 | Walsh | 51/283 |
| 3,857,123 | 12/1974 | Walsh | 51/131 |
| 4,194,324 | 3/1980 | Bonora | 51/131.5 |
| 4,270,316 | 6/1981 | Kramer | 451/288 |
| 4,313,284 | 2/1982 | Walsh | 51/131.4 |
| 4,316,757 | 2/1982 | Walsh | 156/286 |
| 4,450,652 | 5/1984 | Walsh | 51/131.4 |
| 4,811,522 | 3/1989 | Gill, Jr. | 51/131.4 |
| 4,897,966 | 2/1990 | Takahashi | 451/287 |
| 4,918,869 | 4/1990 | Kitta | 451/288 |
| 4,918,870 | 4/1990 | Torbert et al. | 51/131.3 |
| 5,193,316 | 3/1993 | Olmstead | 51/131.4 |
| 5,605,488 | 2/1997 | Ohashi et al. | 451/288 |

FOREIGN PATENT DOCUMENTS

| | | | |
|---|---|---|---|
| 13-0062668 | 3/1988 | Japan | 51/131.4 |

*Primary Examiner*—Robert A. Rose

*Attorney, Agent, or Firm*—Senniger, Powers, Leavitt & Roedel

[57] ABSTRACT

Wafer processing apparatus for batch processing of wafers comprises a turntable, having a polishing surface thereon, capable of rotation about a turntable rotation axis. A pressure plate is constructed for simultaneously holding multiple wafers with a polish face of the wafers facing the polishing surface of the turntable. A polisher head capable of applying a normal force to the pressure plate is provided to drive the pressure plate toward the turntable so that the polish face of the wafers engages the polishing surface of the turntable for polishing of the wafers. A force distributing member intermediate the polisher head and the pressure plate is constructed for uniformly distributing the force applied by the polisher head to the pressure plate.

8 Claims, 3 Drawing Sheets

FIG. 6

LIQUID FILLED FORCERING TEST

| LIQUID FILLED | | | | | REGULAR FORCE RINGS | | | |
|---|---|---|---|---|---|---|---|---|
| | SFPD | TAPER | TTV | | | SFPD | TAPER | TTV |
| | 0.45 | −0.21 | 0.97 | | | 1.07 | −4.01 | 9.87 |
| | 0.35 | 1.35 | 1.21 | | | 0.77 | 7.07 | 6.29 |
| | 0.4 | 1.5 | 1.21 | | | 1.17 | −6.54 | 10.01 |
| | 0.31 | 0.1 | 0.59 | | | 0.7 | 1.2 | 4.72 |
| | 0.26 | 0.34 | 0.43 | | | 0.42 | 2.06 | 1.93 |
| | 0.24 | 0.14 | 0.42 | | | 0.91 | −1.41 | 4.66 |
| | 0.51 | 2.86 | 2.89 | | | 1.07 | 2.19 | 5.14 |
| | 0.45 | 3.08 | 2.49 | | | 0.91 | −4.65 | 7.11 |
| | 0.48 | 2.54 | 2.37 | | | 0.87 | 6.12 | 5.86 |
| | 0.47 | 2.24 | 2.02 | | | 0.9 | −3.33 | 7.54 |
| | 0.3 | 1.33 | 0.97 | | | 0.78 | −0.14 | 5.3 |
| | 0.4 | 2.27 | 2.24 | | | 0.59 | 2.22 | 2.21 |
| | 0.21 | 1.05 | 0.85 | | | 0.94 | −6.15 | 5.66 |
| | 0.64 | 1.28 | 1.10 | | | 0.49 | 0.89 | 0.86 |
| | 0.72 | 1.98 | 1.70 | | | 0.31 | −0.05 | 0.82 |
| | 0.45 | 2.27 | 1.71 | | | 0.95 | −5.62 | 7.5 |
| | 0.35 | 1.18 | 1.23 | | | 0.82 | −1.13 | 6.27 |
| | 0.40 | 1.61 | 1.53 | | | 0.54 | 1.26 | 4.73 |
| | | | | | | 0.7 | 0.08 | 5.49 |
| MAX | 0.72 | 3.08 | 2.89 | | | 0.89 | 0.14 | 6.53 |
| AVG | 0.411 | 1.495 | 1.441 | | | 0.78 | 7.19 | 6.88 |
| MIN | 0.21 | −0.21 | 0.42 | | | 0.88 | 0.66 | 7.32 |
| STD | 0.131 | 0.967 | 0.729 | | | 0.88 | −0.02 | 6.5 |
| | | | | | | 0.86 | 7.15 | 6.26 |
| | | | | | | | | |
| | | | | | MAX | 1.17 | 7.19 | 10.01 |
| | | | | | AVG | 0.800 | 0.216 | 5.644 |
| | | | | | MIN | 0.31 | −6.54 | 0.82 |
| | | | | | STD | 0.209 | 4.020 | 2.359 |

WAFER PROCESSING APPARATUS

BACKGROUND OF THE INVENTION

This invention relates to apparatus for batch processing wafers of semiconductor or similar type material, and more specifically to such apparatus which permits batch processing of the wafers with improved uniformity, throughput and yield.

Polishing an article to produce a surface which is highly reflective and damage free has application in many fields. A particularly good finish is required when processing an article such as a wafer of semiconductor material in preparation for printing circuits on the wafer by an electron beam-lithographic or photolithographic process. Flatness of the wafer surface on which circuits are to be printed is critical in order to maintain resolution of the lines, which can be as thin as 1 micron or less.

Flatness is quantified using a number of measuring methods. For example, "Taper" is a measurement of the lack of parallelism between the unpolished back surface and a selected focal plane of the wafer. "TIR", or Total Indicated Reading, is the difference between the highest point above the selected focal plane and the lowest point below the focal plane, and is always a positive number. "FPD", or Focal Plane Deviation, is the highest point above, or the lowest point below, the chosen focal plane and may be a positive or negative number. "TTV", or Total Thickness Variation, is the difference between the highest and lowest elevation of the polished front surface of the wafer. Presently, flatness of the polished surfaces of wafers is not significantly improved, and may be worsened, by the polishing process. In batch processing using currently known polishing apparatus, there will be a significant number of wafers which fail to meet flatness and polishing specifications after polishing, thus adversely affecting yield in commercial production.

Conventional batch polishing machines include a disc-shaped polishing pad mounted on a turntable for driven rotation about a vertical axis passing through the center of the pad. The wafers are fixedly mounted on a pressure plate above the polishing pad and forced into polishing engagement with the rotating polishing pad. A polishing slurry, typically including chemical polishing agents and abrasive particles, is applied to the pad. In order to achieve the degree of polishing needed, a polisher head is driven against the pressure plate by a hydraulic cylinder to apply a substantial normal force to the plate for pressing the wafers into polishing engagement with the pad.

Batch wafer processing using the conventional batch polishing machine described above has a number of associated disadvantages. For example, the wafers tend to become tapered toward their peripheral edges during batch polishing. Also, where the surface of the polisher head and/or the pressure plate contains non-uniformities, such as where the surface contains dirt build-up or contains irregularities (e.g., bumps, cavities, etc.) caused during manufacture or subsequent damage, the driving force of the polisher head is non-uniformly transferred to the pressure plate. This results in non-uniform pressure between the wafers and the polishing pad, causing a deterioration of the flatness and parallelism of the wafers and a lack of consistency between wafers of the same batch.

Moreover, during the polishing process, the coefficient of friction between the polishing pad and the wafers is quite high, oftentimes in the vicinity of two. This friction causes substantial temperature increases, including in the polisher head, which can result in deformation of the polisher head surface. This leads to the same non-uniform force transfer problems discussed above. To minimize this risk, water or other coolant must be circulated in the polisher head to continually cool the polisher head surface and reduce the deformation of the surface. This circulation system thus increases the complexity and cost of manufacturing the conventional polishing apparatus.

It is known to provide fiberglass or felt rings between the polisher head and the pressure plate to overcome the tapering of the peripheral edges of the wafers during batch processing. The ring has a diameter smaller than the pressure plate and polisher head diameter so that the driving force of the polisher head is transferred to the pressure plate in an annular pattern inward of the edges of the pressure plate. This causes the pressure plate to bend upward slightly at its edges, thereby reducing the tapering of the wafers at the edges of the wafers. However, because they are solid, the material from which the ring is constructed cannot be redistributed to other portions of the ring when it is deformed (e.g., compacted) by non-uniformities in the surfaces of the polisher head and pressure plate. Thus, a localized force is transferred through the ring to the pressure plate, causing non-uniform pressure driving the wafers against the polishing pad. In addition, these rings cannot be produced with a sufficiently uniform compressive strength and thickness to transmit a uniform pressure over the entire area of contact between the polisher head and the pressure plate.

The problems of yield associated with batch processing are somewhat alleviated by single wafer processing, in which each wafer has its own polisher head. In my previously issued U.S. Pat. No. 5,193,316, I disclosed a fluid filled bag that can be used for processing a single wafer and reduces the effect of surface non-uniformities. The bag is generally equal in size to the wafer and is placed between the wafer and an individual piston head that forces the wafer against the polishing surface so that non-uniformities of the piston surface do not negatively affect polishing of the wafer. Single wafer processing also eliminates the problems of forces transmitted through the pressure plate from one wafer to another. However, this fluid filled bag cannot be used for batch polishing, such as by being placed between the polisher head and the pressure plate, because a uniform transfer of force from the polisher head over substantially the entire surface of the pressure plate would result in tapering of the peripheral edges of the wafers in the same manner as described above with respect to the conventional polishing apparatus. In addition, single wafer polishing has a very low throughput because only a single wafer per pressure plate is polished at a time.

SUMMARY OF THE INVENTION

Among the several objects and features of the present invention may be noted the provision of a batch wafer polishing apparatus which improves the flatness of the wafers processed; the provision of such an apparatus which increases yield in batch wafer polishing; the provision of such an apparatus in which pressure applied to each wafer during polishing is substantially equal; the provision of such apparatus which accommodates deformities of the polisher head and pressure plate surfaces; the provision of such an apparatus in which the need for cooling the polisher head is eliminated, and the provision of such an apparatus which is less complex, has a reduced risk of mechanical failure, and is more economical to manufacture.

Generally, wafer processing apparatus constructed according to the principles of the present invention comprises a turntable, having a polishing surface thereon, capable of rotation about a turntable rotation axis. A pressure plate is constructed for simultaneously holding multiple wafers with a polish face of the wafers facing the polishing surface of the turntable. A polisher head capable of applying a normal force to the pressure plate is provided to drive the pressure plate toward the turntable so that the polish face of the wafers engages the polishing surface of the turntable for polishing of the wafers. A force distributing member intermediate the polisher head and the pressure plate is constructed for uniformly distributing the force applied by the polisher head to the pressure plate.

Other objects and features of the present invention will be in part apparent and in part pointed out hereinafter.

BRIEF DESCRIPTION OF THE DRAWINGS

FIG. 6 is table of flatness characteristics data of wafers processed with apparatus of the present invention.

Corresponding reference characters indicate corresponding parts throughout the several views of the drawings.

DETAILED DESCRIPTION OF THE PREFERRED EMBODIMENT

Figure 1:
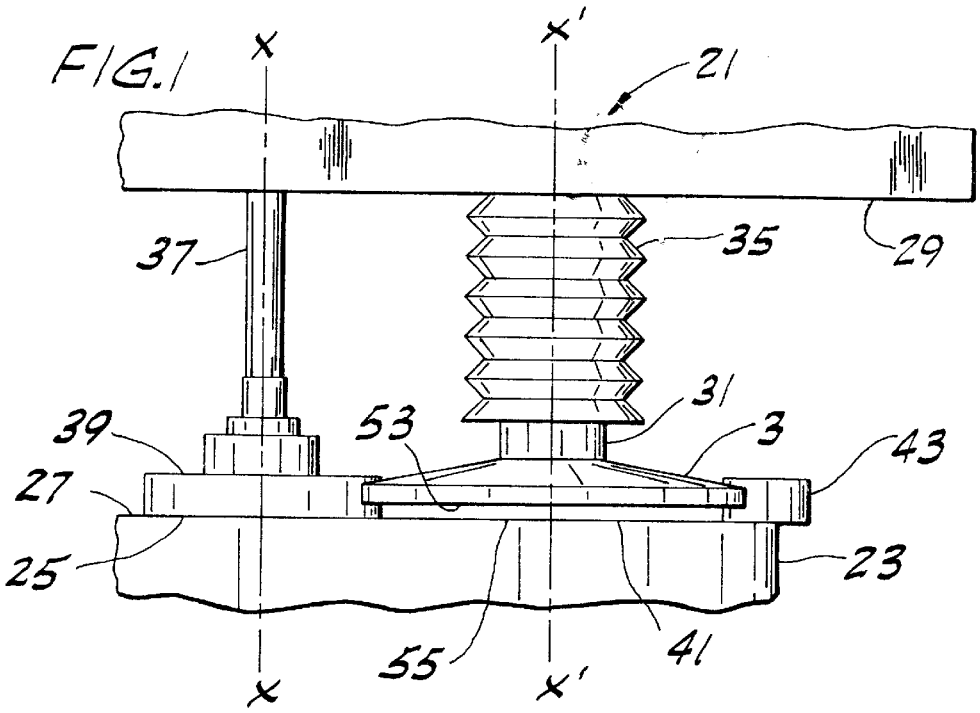
FIG. 1 is a schematic, fragmentary elevation of a polishing apparatus of the present invention showing a polisher head in a lowered position.

Referring now to the drawings and in particular to FIG. 1, polishing apparatus constructed according to the principles of the present invention is generally indicated at 21. The polishing apparatus is of a conventional construction and comprises a turntable 23 mounted on a frame (not shown) for rotation with respect to the frame about a turntable rotation axis X. The turntable 23 of the illustrated embodiment is a steel plate having a diameter in the range of 50–60 inches, although the size of the turntable may vary depending on the number of wafers to be polished during batch processing of the wafers. A generally disc-shaped polishing pad 25, such as those used in conventional polishing apparatus, is mounted on the turntable 23 for conjoint rotation about the turntable axis X and provides a polishing surface 27 for polishing the wafers. A suitable motor (not shown) is operable for driving rotation of the turntable 23 (and polishing pad 25) about the turntable axis X.

An overhead support 29 is supported above the turntable 23 by columns (not shown) extending up from the frame. The overhead support 29 mounts four hydraulic cylinders (not shown), each having a vertically extending arm 31 (one of which is shown in FIG. 1) to which a polisher head 33 is attached. A flexible sleeve 35 covers the arm 31 to inhibit dirt from entering the hydraulic cylinder. A central drive shaft 37 having a rotation axis coincident with the turntable axis X extends down from the overhead support 29 and is rotatingly driven by a second motor (not shown) about its rotation axis relative to the overhead support and the turntable 23. A disc-shaped central drive plate 39 is attached to the drive shaft 37 in closely spaced relationship with the turntable 23 for conjoint rotation about the rotation axis of the drive shaft in close proximity to the polishing surface 27 of the polishing pad 25. For purposes of further description, the apparatus will be described with reference only to the arm 31 and polisher head 33 illustrated in FIG. 2, it being understood that the remaining three arms and polisher heads are of the same construction as that illustrated.

Figure 2:
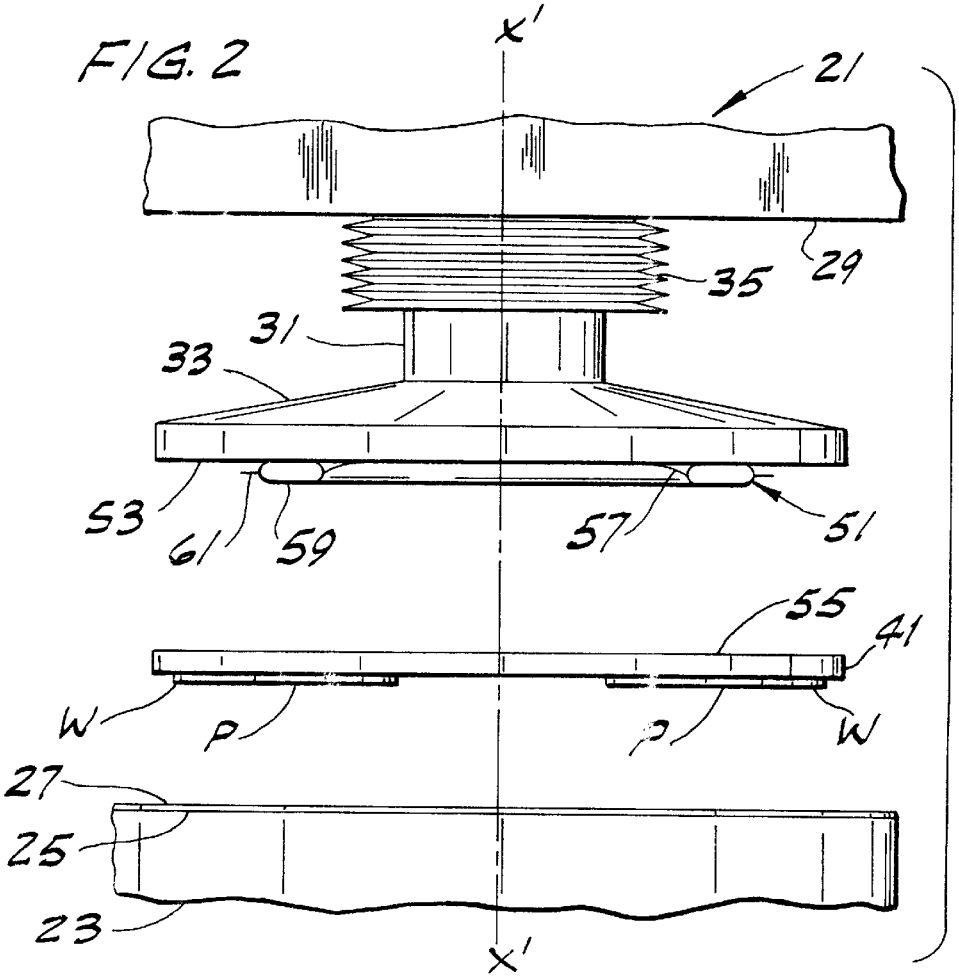
FIG. 2 is an enlarged schematic, fragmentary elevation of the polishing apparatus showing the polisher head in a raised position and a polishing plate exploded upwardly from a turntable.

A disc-shaped pressure plate 41 constructed for simultaneously holding multiple wafers W is situated on the polishing pad 25 between the polisher head 33 and the polishing surface 27 of the pad. The pressure plate 41 is preferably constructed of ceramic material and has a diameter substantially equivalent to that of the polisher head 33. As shown in FIG. 2 wafers W are mounted on the pressure plate 41 in a suitable fashion, such as by conventional wax mounting. A polishing face P of the wafers W faces downward in opposing relationship with the polishing surface 27 of the polishing pad 25.

The hydraulic cylinder is operable to move the arm 31 and attached polisher head 33 along a vertically oriented polisher head axis X' between a raised position (FIG. 2) in which the head is substantially spaced apart from the turntable 23 to permit loading and unloading of the pressure plate 41 with wafers W into and out of the apparatus 21, and a lowered position in which the polisher head is driven down toward the polishing surface 27 of the polishing pad 25. The polisher head 33 and pressure plate 41 are sized such that their peripheral edges frictionally engage the central drive plate 39 whereby rotation of the drive plate effects rotation of the polisher head and pressure plate about the polisher head axis X'. A guide roller 43 is mounted on the frame at the periphery of the turntable 23 and is engageable with the polisher head 33 and pressure plate 41 to assist in holding the polisher head and pressure plate from rotation about the turntable axis X during polishing of the wafers W, but permitting rotation about the polisher head axis X'.

In the lowered position of the polisher head 33, the hydraulic cylinder applies a downward force to the pressure plate 41 to drive the wafers W against the polishing surface 27 of the polishing pad 25 with sufficient force to produce the necessary finish on the polish face P of the wafers. The frame, turntable 23, overhead support 29, columns, hydraulic cylinders, central drive shaft 37 and drive plate 39, guide rollers 43, polisher heads 33 and pressure plates 41 are all of conventional construction, being of the type present on existing polishing machines. Other conventional constructions of the polishing apparatus may also be used, such as where the pressure plate 41 is connected to the polisher head 33 for conjoint movement therewith and where each polisher head is independently driven about its axis X', without departing from the scope of this invention.

Figure 4:
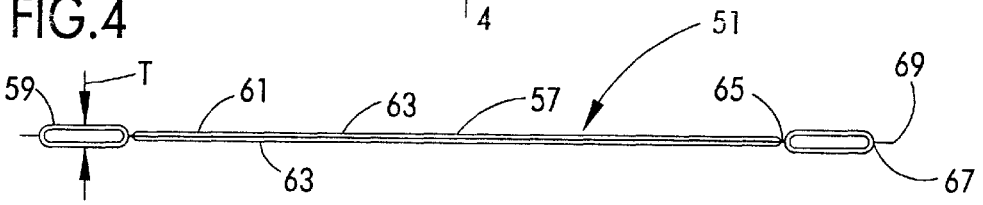
FIG. 4 is a cross-section taken in the plane of line 4—4 of FIG. 3.

With further reference to FIG. 2, a force distributing member, generally indicated at 51, is attached to a lower surface 53 of the polisher head 33 such that it is sandwiched between the polisher head and an upper surface 55 of the pressure plate 41 in the lowered position of the polisher head. As shown in FIG. 4, the force distributing member 51 comprises a generally disc-shaped web 57 and a ring-shaped bladder 59 encircling the periphery of the web. The bladder 59 preferably contains water, although it is contemplated that other fluids, such as air or other suitable gases or liquids may be used instead of water and remain within the scope of the invention. The force distributing member 51 is constructed of a sufficiently flexible material to permit compression of the bladder 59 between the polisher head 33 and the pressure plate 41 without bursting or leaking, and to allow the material to conform to any non-uniformities in the surfaces 53, 55 of the polisher head and the pressure plate. As an example, the bladder 59 of the force distributing member 51 is preferably capable of withstanding at least 600 lbs. of evenly applied force between the polisher head 33 and pressure plate 41 without leaking. An upper surface 61 of the force distributing member 51 is preferably coated with an adhesive for securing the member to the lower surface 53 of the polisher head 33. It is understood, however, that the force distributing member 51 may include only the ring-shaped bladder 59, and that the member may be attached to the pressure plate 41 instead of the polisher head 33 or may be free of connection to either of the polisher head and pressure plate without departing from the scope of this invention.

In a preferred construction of the force distributing member 51 illustrated in FIG. 4, two disc-shaped sheets 63 of a suitably flexible material, such as polyvinyl chloride, are overlaid and welded together along a pair of radially spaced weld lines 65, 67 extending circumferentially about the sheets. The weld lines 65, 67 provide a tight seal between the sheets 63 so that the portions of the sheets between the weld lines define the ring-shaped bladder 59. The web 57 is defined by the portions of the sheets 63 interior of the innermost weld line 65. A third (outer) weld line 69 extends about the peripheral edges of the sheets 63 to further secure the sheets together. A small portion of the sheets 63 is left unwelded along the two outermost weld lines 67, 69 to provide an inlet 71 communicating with the interior of the bladder 59 to permit filling of the bladder with the fluid. Once the bladder 59 is filled, the inlet 71 is welded shut along the outer weld line 69 to seal the fluid within the bladder. It is understood that the force distributing member 51 may be constructed of materials other than polyvinyl chloride, such as polyethylene, Mylar, or other suitable flexible materials. It is also understood that the force distributing member 51 may be constructed in other manners, such as by enclosing a ring-shaped bladder 59 between two sheets (not shown) of material so that the outer sheets of material further protect the bladder against damage, without departing from the scope of this invention.

Figure 3:
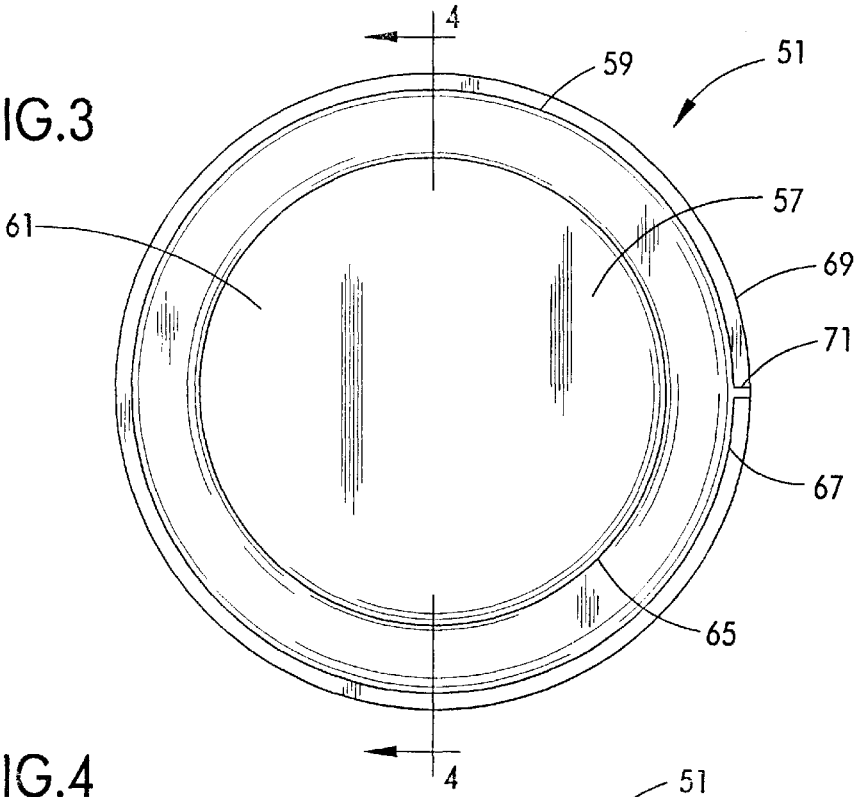
FIG. 3 is a top plan view of a force distributing member of the polishing apparatus.

The outer diameter of the ring-shaped bladder 59 is sized such that the bladder engages the upper surface 55 of the pressure plate 41 radially inward of the edge of the plate. As illustrated in FIG. 2, the bladder 59 is most preferably sized so that it is aligned generally above the centers of the wafers W mounted on the opposite side of the pressure plate. As an example, the outer diameter of the bladder 59 of the force distributing member 51 shown in FIGS. 3 and 4 is approximately 18.0 inches, with the inner diameter of the bladder being approximately 14.5 inches so that the width of the bladder is about 1.75 inches. The thickness T of the ring-shaped bladder 59 when filled with fluid is preferably about 0.3 inches. However, it is understood that these dimensions may vary depending on the desired volume of the bladder 59 and the size and relative location of the wafers W on the pressure plate 41.

In operation, selected semiconductor wafers W are mounted on the pressure plate 41 in a conventional manner using wax. With the polisher head 33 (and attached force distributing member 51 with filled bladder 59) in its raised position, the pressure plate 41 is placed on the polishing pad 25 in engagement with the central drive plate 39 and the guide roller 43 so that the polish face P of the wafers W mounted on the pressure plate engages the polishing surface 27 of the polishing pad. The motor for the turntable 23 is operated to rotate the turntable (and polishing pad 25) about the turntable axis X and the hydraulic cylinder is then operated to lower the polisher head 33 until the force distributing member 51 engages the upper surface 55 of the pressure plate 41. Next, the central drive plate 39 is rotated via the motor for the central drive shaft 37, thereby effecting rotation of the pressure plate 41 and polisher head 33 about the polisher head axis X'. The hydraulic cylinder drives the polisher head 33 toward the pressure plate 41 with sufficient force to press the polish face P of the wafers W into polishing engagement with the polishing surface 27 of the polishing pad 25. The ring-shaped bladder 59 is compressed between the polisher head 33 and the pressure plate 41 so that the fluid pressure in the ring-shaped bladder transfers the force acting on the polisher head to the pressure plate. The force is applied to the pressure plate 41 over an annular area radially inward of the edge of the pressure plate (e.g., corresponding to the area of engagement between the bladder 59 and the plate) so that the plate tends to bend slightly upward toward its edge margins. Since the bladder 59 engages the pressure plate 41 generally centrally over the wafers W, the pressure exerted on the wafers by the pressure plate is substantially uniform over the entire surface of each wafer and is uniformly distributed among all wafers on the pressure plate.

In the event that non-uniformities are present on the surface 53 of the polisher head 33 or the surface 55 of the pressure plate 41, the flexible outer wall of the bladder 59 conforms to the non-uniformity, thereby narrowing the thickness T of the bladder in the region of the non-uniformity. Since the thickness T is narrowed, the fluid in the bladder 59 in the region of the non-uniformity is redistributed throughout the bladder so that the fluid pressure in the bladder remains substantially uniform throughout. Also, as the temperature of the polisher head 33 increases due to friction between the wafers W and the polishing pad 25, any deformation in the lower surface 53 of the polisher head 33 is alleviated by the ring-shaped bladder 59 in a similar manner. Therefore, a uniform force is transferred to the pressure plate 41, above the centers of the wafers W, thereby uniformly pressing the polish face P of the wafers against the polishing pad 25 for uniform polishing of the wafers. The polishing pressure thus remains more nearly the same over the entire polish face P of each wafer so that a uniform, high-quality finish is obtained.

EXAMPLE

A set of 150 mm diameter semiconductor wafers were polished in a Speedfam polisher, Model No. 50-SPAW, which is constructed in a manner substantially the same as the apparatus 21 illustrated and described herein, with a conventional polyurethane felt ring (not shown) placed between the polisher head 33 and the pressure plate 41. The flatness characteristics of the processed wafers W were measured and recorded in the table of FIG. 6. A second set of wafers W was polished in the same apparatus 21 with a force distributing member 51 of the present invention placed between the polisher head 33 and the pressure plate 41. The flatness characteristics of the processed wafers W were measured and recorded in FIG. 6. All of the wafers W were processed using the same polisher head 33 of the apparatus 21.

With reference to FIG. 6, the flatness characteristics of the wafers W polished using the fluid-filled force distributing member 51 were substantially improved in comparison to the wafers processed using conventional polishing apparatus. For example, the average TTV value was reduced from approximately 5.6 microns with the felt ring to about 1.4 microns when using the fluid-filled force distributing member. The Taper values are listed as both positive and negative numbers. However, the average absolute (not shown in the table) Taper was reduced from about 3.0 microns to about 1.5 microns. The average Site Focal Plane Deviation, which is a local (e.g., 15 millimeters square) measurement of the highest point above, or the lowest point below, a chosen focal plane within the measured area, was reduced from about 0.8 to about 0.4.

Figure 5:
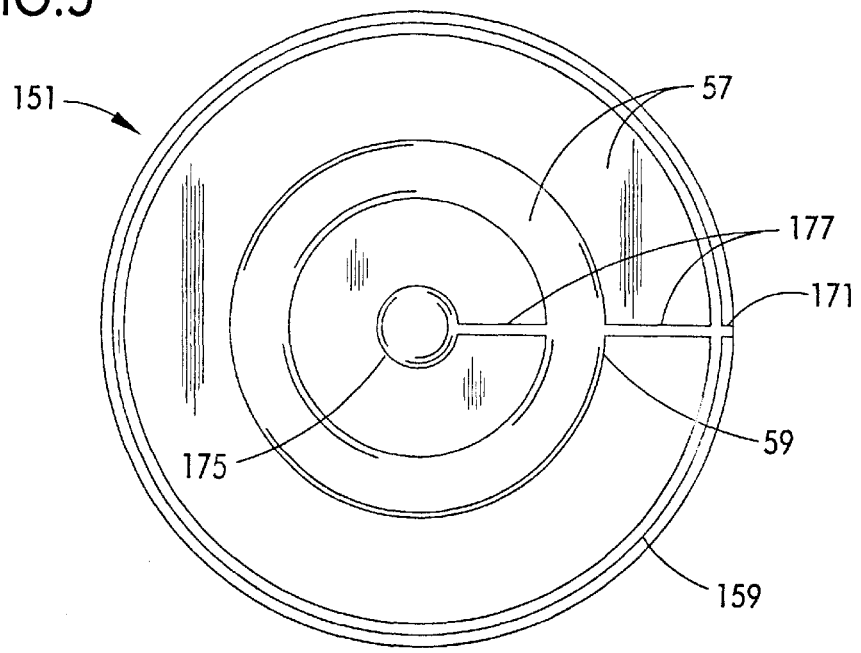
FIG. 5 is a top plan view of a force distributing member of a second embodiment.

FIG. 5 illustrates a second embodiment of a force distributing member 151 in which the member includes a central fluid filled pocket 175, the ring-shaped bladder 59, and a second ring-shaped bladder 159 spaced radially outward of the ring-shaped bladder 59. In this embodiment, the outermost ring-shaped bladder has a diameter substantially equal to the diameter of the pressure plate so that it lies generally along the edge margin of the plate. The web 57 extends between the pocket 175 and the innermost bladder 59 and between the inner and outer bladders 59, 159. A channel 177 extends from the inlet 171, through the ring-shaped bladders 59, 159, and to the central pocket 175 SO that the bladders and the pocket are in fluid communication. Providing the central pocket 175 and the additional ring-shaped bladder 159 at the edge margin of the pressure plate changes the locations at which the force from the polisher head is transferred to the pressure plate 41. For example, the force will now be transferred to the pressure plate 41 generally at the central pocket 175 of the member, in an annular pattern at the inner ring-shaped bladder 59 and in another annular pattern at the outer ring-shaped bladder 159.

By changing the force distribution on the pressure plate 41, the shape of the pressure plate due to bending caused by the forces from the polisher head is changed, thereby changing the pressure distribution over the wafers W mounted on the pressure plate. This allows the operator to polish different areas of the wafer, such as the center, to a different degree of finish than other areas of the wafer, such as the edge of the wafer.

The pattern of force transfer from the polisher head 33 to the pressure plate 41 can also be controlled by changing the width of the bladder. As an example, the width of the outer bladder 159 of the illustrated embodiment of FIG. 5 is substantially less than that of the inner bladder 59 so that the amount of force transferred to the edge of the pressure plate 41 is substantially less than the amount of force transferred to the portion of the pressure plate engaged by the inner bladder. The channel 177 allows the fluid in the bladders 59, 159 and pocket 175 to be redistributed among one another to maintain uniform fluid pressure in the bladders and pocket in the event that non-uniformities are present in the surfaces 53, 55 of the polisher head 33 and pressure plate 41. However, the channel 177 is sufficiently smaller in thickness than the pocket 175 and ring-shaped bladders 59, 159 so that the channel cannot exert pressure on the pressure plate 41. It is understood that other force distributing member configurations may be used to provide a desired pattern of force transfer between the polisher head 33 and the pressure plate 41, with any number of ring-shaped bladders, without departing from the scope of this invention.

In view of the above, it will be seen that the several objects of the invention are achieved and other advantageous results attained. The fluid filled force distributing member 51, which is constructed of a flexible material and placed between the polisher head 33 and the pressure plate 41, provides a uniform transfer of force between the polisher head and the pressure plate, resulting in a uniform pressure between the wafers W and the polishing pad 25. The annular shape of the bladder 59 focuses the force of the polisher head 33 on the pressure plate 41 centrally above the wafers W to reduce the risk of tapering of the peripheral edges of the wafers. By providing a more uniform polishing pressure between the wafers W and the polishing pad 25, the resulting wafers have improved flatness characteristics. This increases the yield of wafers since more of the wafers produced during the batch polishing will meet the customers quality specifications. Also, the bladder 59 functions as a frictionless gimbal between the polisher head 33 and the pressure plate 41 to overcome tilting of the pressure plate caused by small variations in the thicknesses of the wafers W. Finally, since the fluid-filled bladder 59 negates the affect of surface non-uniformities, deformation of the polisher head lower surface 53 due to temperature increase during the polishing operation is easily overcome, thereby eliminating the need for a cooling system to actively cooling the polisher head. This reduces the complexity of the apparatus so that the apparatus is less susceptible to mechanical failure and is less costly to manufacture.

As various changes could be made in the above constructions without departing from the scope of the invention, it is intended that all matter contained in the above description or shown in the accompanying drawings shall be interpreted as illustrative and not in a limiting sense.

What is claimed is:

1. Wafer processing apparatus comprising:

a turntable capable of rotation about a turntable rotation axis, the turntable having a polishing surface thereon;

a pressure plate constructed for simultaneously holding multiple wafers with a polish face of the wafers facing the polishing surface of the turntable;

a polisher head capable of applying a normal force to the pressure plate to drive the pressure plate toward the turntable so that the polish face of the wafers engages the polishing surface of the turntable for polishing of the wafers; and a force distributing member intermediate the polisher head and the pressure plate, the force distributing member being constructed for uniformly distributing the force applied by the Polisher head to the pressure plate, the force distributing member comprising a disc-shaped web having a peripheral edge, and a ring-shaped bladder attached to the peripheral edge of the web, the ring-shaped bladder containing a fluid.

2. Wafer processing apparatus as set forth in claim 1 wherein the polisher head and pressure plate each have a respective surface engaged by the ring-shaped bladder of the force distributing member, the ring-shaped bladder being constructed of a sufficiently flexible material so that the bladder can be compressed between the polisher and pressure plate and substantially conforms to any non-uniformities of the polisher head and pressure plate surfaces engaged by the bladder, the fluid in the bladder being redistributed upon deformation of the bladder to maintain a uniform fluid pressure in the bladder.

3. Wafer processing apparatus as set forth in claim 1 wherein the fluid contained in the bladder is water.

4. Wafer processing apparatus as set forth in claim 1 wherein the ring-shaped bladder has a thickness in the range of 0.25–0.35 inches when filled with the fluid.

5. Wafer processing apparatus as set forth in claim 2 wherein the web is attached to the polisher head for securing the force distributing member on the polisher head.

6. Wafer processing apparatus as set forth in claim 2 wherein the force distributing member comprises a pair of generally disc-shaped sheets of the flexible material, the sheets being overlaid and welded together in sealing engagement along a pair of radially spaced apart weld lines extending circumferentially about the sheets, the area between the weld lines defining the ring-shaped bladder.

7. Wafer processing apparatus as set forth in claim 1 wherein said ring-shaped bladder is a first ring-shaped bladder, the force distributing member further comprising a second ring-shaped bladder attached to the web and spaced radially inward of the first ring-shaped bladder, the first and second bladders having substantially the same thickness when filled with the fluid, and a conduit extending between the first and second bladders to provide fluid communication between the bladders, the conduit having a thickness substantially less than the thickness of the bladders.

8. Wafer processing apparatus as set forth in claim 1 wherein the force distributing member further comprises a central pocket attached to the center of the web, the pocket having a thickness substantially equal to the thickness of the ring-shaped bladder and being adapted for containing the fluid, and a conduit extending between the pocket and the ring-shaped bladder to provide fluid communication between the pocket and the bladder, the conduit having a thickness substantially less than the thickness of the ring-shaped bladder.

* * * * *

UNITED STATES PATENT AND TRADEMARK OFFICE

CERTIFICATE OF CORRECTION

PATENT NO. : 5,975,998

DATED : November 2, 1999

INVENTOR(S) : Dennis L. Olmstead

It is certified that error appears in the above-identified patent and that said Letters Patent is hereby corrected as shown below:

On the Title page "[73] Assignee: MEMC Electronic Materials, Inc., St. Peters, Mich." should show -- [73] Assignee: MEMC Electronic Materials, Inc., St. Peters, MO --.

Signed and Sealed this

Eighth Day of August, 2000

*Attest:*

*Attesting Officer*

Q. TODD DICKINSON

*Director of Patents and Trademarks*